US011698000B2

(12) United States Patent
Shitaka et al.

(10) Patent No.: US 11,698,000 B2
(45) Date of Patent: Jul. 11, 2023

(54) DAMAGE EVALUATION DEVICE, DAMAGE EVALUATION METHOD

(71) Applicant: TOSHIBA ENERGY SYSTEMS & SOLUTIONS CORPORATION, Kawasaki (JP)

(72) Inventors: Tetsuya Shitaka, Yokohama (JP); Yusuke Suzuki, Yokohama (JP); Yoshikazu Ninomiya, Nerima (JP)

(73) Assignee: TOSHIRA ENERGY SYSTEMS & SOLUTIONS CORPORATION, Kawasaki (JP)

( * ) Notice: Subject to any disclaimer, the term of this patent is extended or adjusted under 35 U.S.C. 154(b) by 0 days.

(21) Appl. No.: 17/857,418

(22) Filed: Jul. 5, 2022

(65) Prior Publication Data

US 2023/0003138 A1 Jan. 5, 2023

(30) Foreign Application Priority Data

Jul. 5, 2021 (JP) ..... 2021-111442

(51) Int. Cl.
*F01D 21/00* (2006.01)

(52) U.S. Cl.
CPC ..... *F01D 21/003* (2013.01); *F05D 2220/31* (2013.01); *F05D 2260/80* (2013.01);
(Continued)

(58) Field of Classification Search
CPC ..... F01D 21/003; F05D 2220/31; F05D 2260/80; F05D 2270/303; F05D 2270/331; F05D 2270/332
See application file for complete search history.

(56) References Cited

U.S. PATENT DOCUMENTS 5,533,413 A * 7/1996 Kobayashi ..... G07C 3/00 73/865.9
9,569,397 B2 * 2/2017 Higgins ..... G06Q 10/20
(Continued)

FOREIGN PATENT DOCUMENTS

JP 63-46242 B2 9/1988
JP 2000-97815 A 4/2000
(Continued)

OTHER PUBLICATIONS

Fujiyama, K., et al., "Procedure for Life Assessment of Degraded Steam Turbine Components and Life Diagnosis System", Material, J. Soc. Mater. Sci., Jpn. (Zairyo), 37 (1988) 414, p. 315, (with unedited computer generated English translation).
(Continued)

*Primary Examiner* — J. Todd Newton
(74) *Attorney, Agent, or Firm* — Oblon, McClelland, Maier & Neustadt, L.L.P.

(57) ABSTRACT

A damage evaluation device evaluates damage of equipment, including an operation data obtaining unit which detects a state of the equipment to obtain the state as operation data; an operating state quantity evaluation unit which calculates an operating state quantity including at least one of temperature and generated stress at a predetermined evaluation-target site of the equipment, based on the operation data; a material deterioration evaluation unit which evaluates a material deterioration quantity of a material forming the equipment, based on the operating state quantity; a risk evaluation unit which evaluates at least one of a cumulative damage quantity of the material forming the equipment and failure risk, based on the operating state quantity and the material deterioration quantity; and a recommended maintenance time presentation unit which pres-
(Continued)

ents a recommended maintenance time of the equipment based on a result of the evaluation of the risk evaluation unit.

4 Claims, 5 Drawing Sheets

(52) U.S. Cl.
CPC .. *F05D 2270/303* (2013.01); *F05D 2270/331* (2013.01); *F05D 2270/332* (2013.01)

(56) References Cited

U.S. PATENT DOCUMENTS

2004/0073400 A1* 4/2004 Tomita ..... F02C 9/00 702/181
2006/0245914 A1* 11/2006 Adam ..... G01K 3/06 415/118
2009/0266150 A1* 10/2009 Novis ..... F01D 21/003 73/112.01
2011/0137575 A1* 6/2011 Koul ..... G05B 23/0245 702/34
2016/0349723 A1* 12/2016 Patel ..... G05B 23/0283
2018/0024544 A1* 1/2018 Unuma ..... B60R 16/0234 701/29.4

FOREIGN PATENT DOCUMENTS

JP 2001-330542 A 11/2001
JP 2020-3373 A 1/2020

OTHER PUBLICATIONS

Suzuki, Y., et al., "Residual Creep Life Assessment for Modified 9Cr—1Mo Steels by Hardness Prediction Model", Proceedings of the JSMS Annual Meetings. The Society of Materials Science, Japan, 61, pp. 331-332 (with unedited computer generated English translation).
Uemura, H., et al., "Temper Embrittlement Characteristics of Cr—Mo—V Steel Steam Turbine Rotors in Long Term Service", Tetsu-to-Hagane, The Iron and Steel Institute of Japan, 93 (2007) 4, pp. 324-329 (with unedited computer generated English translation).

* cited by examiner

| | | TOTAL OPERATING TIME | | |
|---|---|---|---|---|
| | | a hr OR MORE | a ~ b hr | b hr OR LESS |
| DAMAGE QUANTITY | A% OR MORE | High | High | Middle |
| | A ~ B % | High | Middle | Low |
| | B% OR LESS | Middle | Low | Low |

DAMAGE EVALUATION DEVICE, DAMAGE EVALUATION METHOD

CROSS REFERENCE TO RELATED APPLICATIONS

This application is based upon and claims the benefit of priority from Japanese Patent Application No. 2021-111442, filed on Jul. 5, 2021; the entire contents of which are incorporated herein by reference.

FIELD

Embodiments described herein relate to a device that evaluates a damage quantity of equipment due to the operation of, for example, a power generator, and a method thereof.

BACKGROUND

It is known that in turbines, casings, control valves, and so on which are the main components of thermal power plants, damages or deteriorations occur and accumulate in places thereof in accordance with the operation and thus increase the failure risk of the components over time. Therefore, to soundly and economically operate these thermal power plants, it is necessary to quantitatively grasp the damages that occur and accumulate in the places of the components in accordance with the operation and execute maintenance such as repairing and part changes at appropriate times.

Examples of the damage include crack initiation and its growth in a member used under a high-temperature environment. It is known that creep and metal fatigue are causes of the crack initiation and growth. Creep is a phenomenon in which a metal material used under an environment whose temperature is about half its melting point undergoes gradual permanent deformation with time even under low stress equal to or less than the yield stress of the metal material and finally cracks, resulting in the rupture of the metal. Fatigue is a phenomenon in which crack is initiated and grown by repeated stress even if the stress is not large enough to cause rupture under a static load, leading to failure. This repeated stress is generated not only by external force but also by thermal stress. For example, in thermal power plant equipment, stress generation is unavoidable during use under a high-temperature environment, during operation, and at the activation and stop times, and damages due to these stresses accumulate in places of the equipment in accordance with the operation. To avoid such damages of the equipment due to creep or fatigue, the thermal power plant equipment requires appropriate maintenance and management.

For example, in a steam turbine, components for which the maintenance and management against damages due to crack initiation and growth is especially important are a turbine shaft (hereinafter referred to simply as a rotor) and a turbine casing. The rotor is a rotary shaft that transmits, to a power generator, rotational force that rotor blades receive from a steam flow, and the turbine casing is a cover surrounding the rotor. The steam flow passes between the turbine casing and the rotor, and the rotor blades provided on the outer periphery of the rotor generate the rotational force from the steam flow. A plurality of stages of the rotor blades are arranged on the outer periphery of the rotor, and when the rotor blades receive the steam flow, the rotational force is generated in the rotor. Meanwhile, the steam having a high temperature when flowing in consumes energy as it passes through the stages of the rotor blades, and thus the temperature of the steam decreases as it goes more downstream. Consequently, not only the rotor and the turbine casing which come in contact with this steam are used in a high-temperature environment but also temperature distribution is generated in the same member.

The rotor and the turbine casing receive thermal stress when changed in temperature by heating and cooling at, for example, the activation and stop times and at the time of load variation. In addition, during operation, centrifugal force due to the high-speed rotation of the rotor constantly generates stress. Such thermal stress causes the accumulation of fatigue damages, and the centrifugal force under the high-temperature environment causes the accumulation of creep damages.

Not only the temperature change and the stress but also the material properties of an evaluation-target member influence the progress of the damage. It is known that the material properties are also deteriorated by a high-temperature environment and load stress. Therefore, as the material deteriorates, it is also necessary to appropriately correct the material properties used for the evaluation of creep damage and fatigue damage.

Hardness decrease and embrittlement are examples of the material deterioration. It is known that material strength and hardness are correlated in most cases, and as hardness decreases, strength properties such as creep and fatigue properties also decrease. In turbine equipment, since it is difficult to obtain a sufficient quantity of strength property evaluation samples having a sufficiently large size from the equipment in operation, changes in such strength properties are often estimated from the measurement results of hardness which is relatively easily measured. Further, the embrittlement of a material influences a crack propagation rate, and thus unless the embrittlement is appropriately evaluated, it is difficult to evaluate crack growth that occurs during operation. That is, the appropriate damage management of the turbine equipment requires the evaluation of the temperature, generated stress, and a material deterioration quantity of each member during the operation of the plant.

In the execution of conventional material deterioration evaluation, the steam turbine is opened when the plant is in non-operation. Material deterioration is evaluated based on hardness measurement or embrittlement evaluation of an evaluation-target site, and the temperature and stress of each part during operation and at the activation and stop times are evaluated based on finite element analysis and design conditions, and from operation data, how many times and how long the evaluation-target site has been exposed to these temperature and stress are evaluated, whereby fatigue damage and creep damage of each site are evaluated. Since this material deterioration progresses as the plant operates, periodic measurement is required for the appropriate evaluation of a material deterioration quantity. However, stopping the power plant and opening the steam turbine take a lot of trouble and time to increase power generation costs. This makes it difficult to execute the evaluation a sufficient number of times because of cost restriction.

Further, in conventional thermal power generation, base-load operation is the mainstream and the operation is often at about rated power at which plant efficiency is the highest. In such an operation case, temperature and stress generated in parts of a rotor and a turbine casing (hereinafter, referred to as "an operating state quantity") are very clear because they are precisely evaluated and optimized when the turbine is designed, and the operating states do not readily vary because turbine power varies only a little during operation.

This makes it relatively easy to calculate the temperature and load stress of an evaluation-target site based on design data and operation history to evaluate creep damage.

However, the recent widespread use of renewable energy has led to increasing opportunities when a thermal power station operates at part load and also to an increasing number of times it is activated and stopped. The increase in the part-load operation leads to an increase in off-design point operation, and as a result, the turbine equipment is exposed for long hours to temperature and load stress that are not expected when it is designed. Because of this, the evaluation of creep damage based on design data and operation history on the premise that the operation is often at about rated power is considered very low in accuracy.

Further, the evaluation of thermal stress caused by a temperature change at the time of load variation or at the activation and stop times also requires accuracy. The magnitude of thermal stress correlates with a variation of the temperature of turbine equipment and temperature distribution in the turbine equipment including peripheral components. As for the temperature change when the turbine stops, the temperature of each place decreases from a steady state owing to natural cooling. Since the cooling rate differs depending on each place, the temperature does not uniformly decrease, but a temperature difference among the peripheral turbine components and a temperature difference in the same member constantly change, leading to the generation of thermal stress. Further, it takes several days for the turbine equipment including a rotor and a casing to be cooled to room temperature. If the plant is activated again before they are cooled to room temperature, temperature distribution at the activation time and a temperature variation up to the time when the temperature returns to the steady state are not uniform, either. That is, the thermal stress repeatedly generated when the plant is activated and stopped differs depending on the activation and stop conditions. Similarly, in part-load operation as well, thermal stress differs depending on a load variation condition. As compared with the conventional operation as a base-load power supply, in the recent operation in which the plant is often activated and stopped and is often operated at part load, these conditions are diversified and are difficult to expect. That is, fatigue damage evaluation simply based on the number of activation and stop times is considered low in accuracy.

For the evaluation of damage due to crack initiation or crack growth in turbine equipment, it is necessary to appropriately evaluate time-dependent material deterioration, creep damage, and fatigue damage. The progress of the material deterioration such as hardness decrease and embrittlement is caused by temperature and load stress. That is, the material deterioration progresses as the plant operates, and thus for appropriate damage evaluation, the periodic evaluation of material properties is necessary. However, for the direct measurement of an evaluation-target site, the turbine has to be opened, which involves time and cost problems. Further, in recent years, it is expected that part-load operation and the number of activation and stop times of a thermal power plant will increase. Consequently, the turbine equipment is exposed for long hours to temperature and pressure not expected when it is designed, and it is worried that creep damage evaluation on the premise that the plant operates at about rated power is low in accuracy. Further, as for fatigue damage due to thermal stress, thermal stress generated in recent diversified operation patterns is difficult to predict, and fatigue damage evaluation simply based on the number of activation and stop times and the number of times load varies is poor in reliability.

DETAILED DESCRIPTION

As described above, conventional damage evaluation devices and damage evaluation methods have problems of the increase in trouble and cost due to the opening of a turbine, and difficulty in achieving highly accurate and reliable evaluation. A damage evaluation device and a damage evaluation method according to an embodiment were made to solve such problems and have an object to achieve adaptability to diversified operations of equipment and highly reliable evaluation.

A damage evaluation device of an embodiment is a damage evaluation device that evaluates damage of equipment, the damage evaluation device including: an operation data obtaining unit which detects a state of the equipment to obtain the state as operation data; an operating state quantity evaluation unit which calculates an operating state quantity including at least one of temperature and generated stress at a predetermined evaluation-target site of the equipment, based on the operation data; a material deterioration evaluation unit which evaluates a material deterioration quantity of a material forming the equipment, based on the operating state quantity; a risk evaluation unit which evaluates at least one of a cumulative damage quantity of the material forming the equipment and failure risk, based on the operating state quantity and the material deterioration quantity; and a recommended maintenance time presentation unit which presents a recommended maintenance time of the equipment based on a result of the evaluation of the risk evaluation unit.

A damage evaluation method is a damage evaluation method of evaluating damage of equipment, the method including: detecting a state of the equipment to obtain the state as operation data; calculating an operating state quantity including at least one of temperature and generated stress at a predetermined evaluation-target site of the equipment, based on the operation data; evaluating a material deterioration quantity of a material forming the equipment, based on the operating state quantity; evaluating at least one of a cumulative damage quantity of the material forming the equipment and failure risk, based on the operating state quantity and the material deterioration quantity; and presenting a recommended maintenance time of the equipment based on a result of the evaluation of at least one of the cumulative damage quantity and the failure risk.

Configuration of Embodiment

Figure 1:
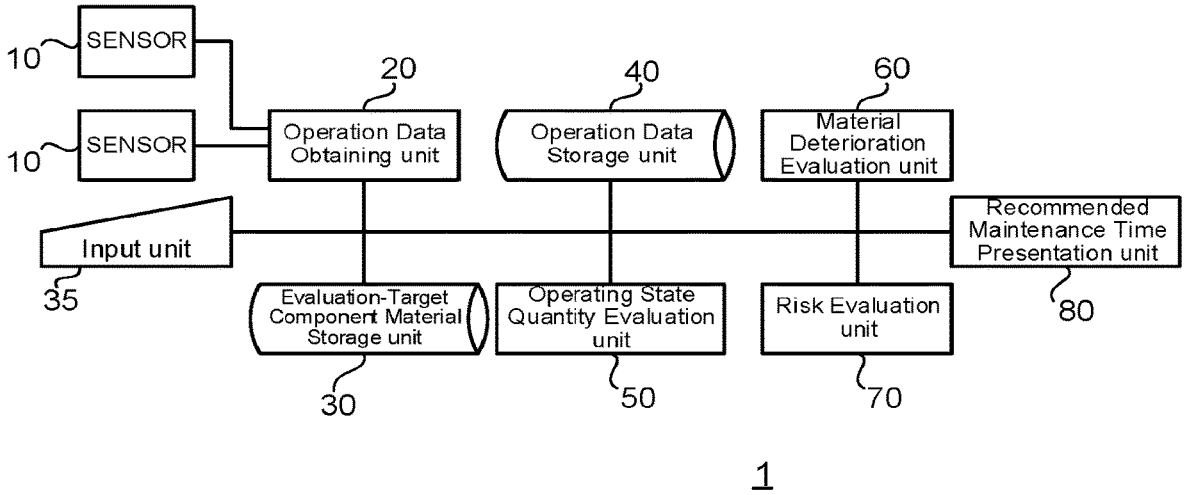
FIG. 1 is a block diagram illustrating the configuration of a damage evaluation device according to an embodiment.

An embodiment will be hereinafter described in detail with reference to the drawings. A damage evaluation device of this embodiment evaluates damage of turbine equipment. As illustrated in FIG. 1, the damage evaluation device 1 of the embodiment includes sensors 10, an operation data obtaining unit 20, an evaluation-target component material storage unit 30, an input unit 35, an operation data storage unit 40, an operating state quantity evaluation unit 50, a material deterioration evaluation unit 60, a risk evaluation unit 70, and a recommended maintenance time presentation unit 80.

The operation data obtaining unit 20 is an arithmetic block that obtains operation data through the sensors 10. The evaluation-target component material storage unit 30 stores material data of materials forming the turbine equipment. The input unit 35 is an input interface, for example, a keyboard, and is used when the material data and so on are stored in advance in the evaluation-target component material storage unit 30 and the like. The operation data storage unit 40 stores the operation data indicating the states of sites of components forming the turbine equipment. The operating state quantity evaluation unit 50 is an arithmetic block that evaluates an operating state quantity based on the operation data obtained by the operation data obtaining unit and other data. The material deterioration evaluation unit 60 is an arithmetic block that evaluates material deterioration using the evaluation result of the operating state quantity and material data such as chemical components of an evaluation-target component. The risk evaluation unit 70 is an arithmetic block that evaluates cumulative damage and failure risk based on the evaluation result of the material deterioration and the evaluation result of the operating state quantity. The recommended maintenance time presentation unit 80 is an interface that presents a recommended maintenance time to a user based on the evaluation results of the cumulative damage and the failure risk and a future plant operation plan.

The evaluation-target component material storage unit 30 stores the data of the materials forming a rotor, a turbine casing, and so on which are components of, for example, the turbine equipment. The evaluation-target component material storage unit 30 can be implemented by a nonvolatile memory, a hard disk drive, or the like.

The operation data storage unit 40 stores the operation data indicating the states of sites of the components forming the turbine equipment. The operation data storage unit 40 can be implemented by a nonvolatile memory, a hard disk drive, or the like. The operation data storage unit 40 may store past operation data as historical data as well as the obtained operation data. The historical data includes the operation data obtained time after time, accumulation history such as the total operating time, variations in temperature, pressure, and so on of the sites at the activation and stop times or at the time when the power varies, and their variations per unit time. The operation data storage unit 40 may store a state quantity corresponding to the operation data of an evaluation-target site and its historical data in addition to the operation data and its historical data.

(Sensors 10)

The sensors 10 obtain the operation data of the turbine equipment. Examples of the operation data obtained by the sensors 10 include the temperatures and pressures of an inlet and an outlet of steam, the temperature and pressure of extracted steam, and the temperature and strain of the casing. Besides, the sensors 10 may detect temperatures and pressures in front of and behind steam valves, the temperature of a steam valve casing, the power and load ratio of the plant, and so on. The sensors 10 are installed in advance at the time when the plant is designed or manufactured, or are newly installed for evaluation.

Figure 2:
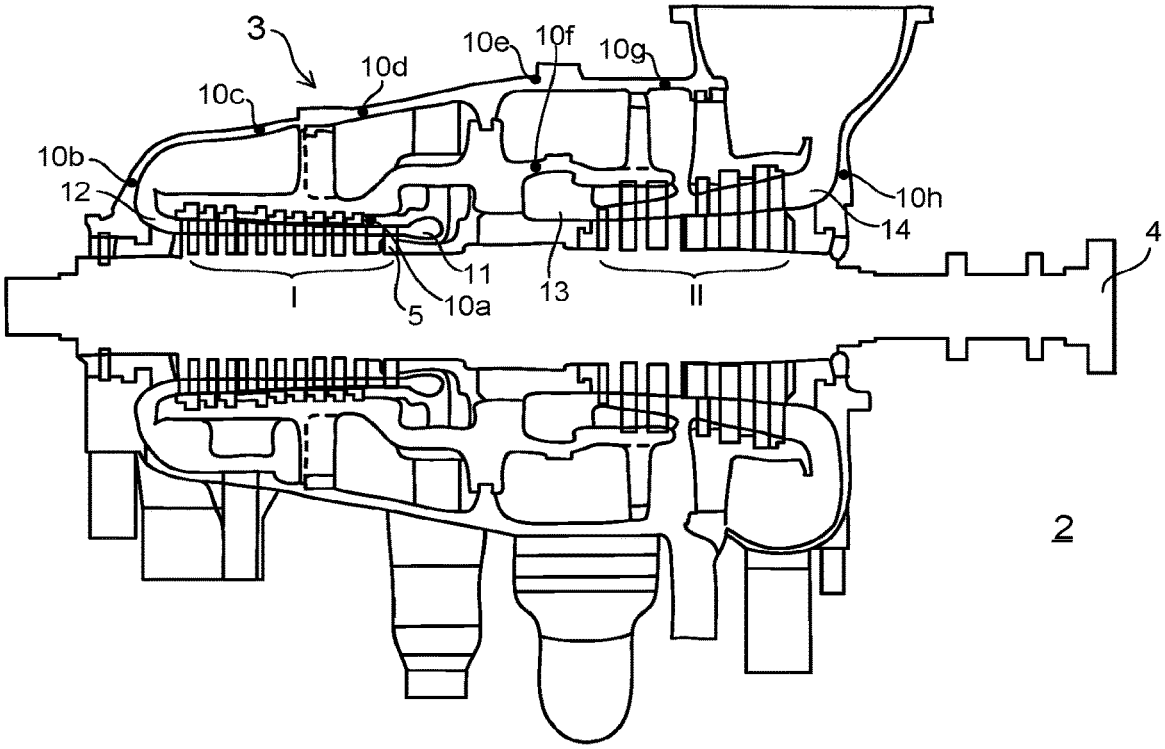
FIG. 2 is a schematic view illustrating an example of the installation positions of sensors according to the embodiment.

FIG. 2 illustrates an example of the installation positions of the sensors in the turbine casing of the turbine equipment. The turbine equipment 2 illustrated in FIG. 2 includes a turbine casing 3, a rotor 4, and a plurality of rotor blades 5 forming a stage group I and a stage group II. In this turbine casing, sensors 10*a* to 10*h* are installed. In the example illustrated in FIG. 2, the sensors 10*a* to 10*h* are temperature sensors for temperature detection.

The sensor 10*a* is installed near a wake flow of the rotor blades 5 of the first stage from a steam inlet 11 in the turbine casing 3. The sensor 10*b* is installed near a steam outlet 12 of the stage group I in the turbine casing 3. The sensors 10*c* and 10*d* are installed near a steam passage downstream of the steam outlet 12 in the turbine casing 3. The sensors 10*e* and 10*g* are installed near the stage group II in the turbine casing 3. The sensor 10*f* is installed near a steam inlet 13 of the stage group II in the turbine casing 3. The sensor 10*h* is installed near a steam outlet 14 of the stage group II in the turbine casing 3.

In the turbine casing 3 illustrated in FIG. 2, to estimate the state quantities of stages of the stage group I, the detection results of the sensor 10*a* near the steam inlet 11 and the sensor 10*b* near the steam outlet 12 are usable. In the calculation of the temperatures of the stages using steam inlet temperature and outlet temperature, estimating steam temperature from temperature measurement data at a position close to the steam inlet enables a reduction in an estimation error of the steam outlet and inlet temperatures. It is also possible to reduce an error in stage temperatures calculated using this.

The installation position of the sensor 10*a* is near the wake flow of the rotor blades of the first stage from the steam inlet 11 in the turbine casing 3 but is not limited to this. The installation positions of the sensors differ depending on design conditions and are not limited to the wake flow of the rotor blades of the first stage and may be other positions. For example, if the design of the turbine casing 3 makes temperature measurement at the position of the sensor 10*b* difficult, this temperature may be estimated using the temperature of the steam passage downstream of the steam outlet 12 which temperature can be detected by the sensor 10*c*, the sensor 10*d*, or the like. Similarly to the sensor 10*a*, sensors may be installed between the stages.

The number of the sensors 10 for the extraction of the operation data is determined according to the number and the positions of sites that are state quantity evaluation targets and an estimation formula, and thus their installation positions are not limited to two places near the steam inlet and the steam outlet. For example, to estimate the temperature near the wake flow of the rotor blades 5 of the first stage from the steam inlet 11 of the stage group I, only data of the sensor 10*a* near the evaluation-target site may suffice. Further, as data extracted for the estimation of the state quantities of stages of the stage group II, the temperatures of sites may be detected using two sensors out of the sensor 10*f*, the sensor 10*g*, and the sensor 10*h* or using the three sensors 10*f*, 10*g*, and 10*h*. Also adoptable is a configuration to prepare the sensors 10 at a plurality of places as data extraction targets and select a sensor that is to collect the data, according to data to be collected such as steam pressure and operating power or data to be estimated such as an estimated state quantity at a given time. This also applies to a pressure or strain sensor, and the arrangement of the sensors can be decided according to a place whose operation data is to be detected and the contents of the operation data.

The method of estimating the temperature of each of the stages using the measurement value of the temperature sensor near the estimation-target stage or in front of or behind the stage has been described, but a measurement value of a pressure sensor may be used in combination with the measurement value of the temperature sensor. For example, to calculate heat transfer, a calculation method using a kinematic viscosity coefficient, Reynolds number, Nusselt number, Prandtl number, or the like is available. To calculate these values, steam pressures are also necessary as parameters. In this case, pressure sensors are provided as the sensors 10, values of these parameters are calculated based on measurement values of the pressure sensors, and the calculated values are combined with the measurement values of the temperature sensors. This enables the calculation of the temperature of an estimation-target stage. In the estimation of pressure, strain, and so on, they can be estimated from a combination of measurement data of a plurality of kinds of state quantities.

(Operation Data Obtaining Unit 20)

The operation data obtaining unit 20 has a function of obtaining the operation data that the sensors 10 provided in the turbine equipment 2 measure during operation, at an appropriate sampling frequency, executing averaging and denoising, and outputting the result to a post-step. The operation data obtaining unit 20 is further capable of selecting a sensor from the sensors 10 installed at the places in the turbine equipment 2, according to the contents of operation data to be obtained and obtaining the desired operation data from the selected sensor 10. That is, in the case where some operation data is to be obtained, the operation data obtaining unit 20 is capable of setting which sensor is to be used and what kind of data (temperature, pressure, or the like) is to be obtained from the selected sensor.

Figure 3:
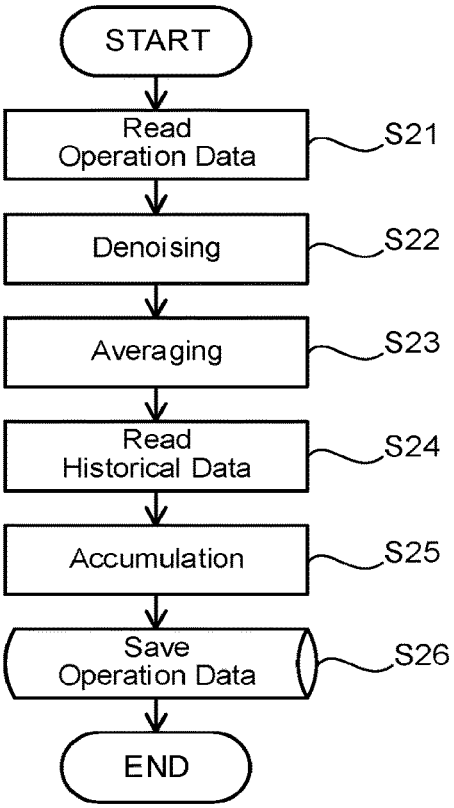
FIG. 3 is a flowchart illustrating an operation of an operation data obtaining unit according to the embodiment.

FIG. 3 illustrates an operation data obtaining operation by the operation data obtaining unit 20. The operation data obtaining unit 20 reads operation data such as temperature or pressure detection data and plant power or load ratio from the sensors 10 installed in the turbine equipment 2 (S21).

After reading the operation data, the operation data obtaining unit 20 executes data processing such as denoising (S22) and averaging (S23) for data reduction.

After reducing the operation data, the operation data obtaining unit 20 reads historical data from the operation data storage unit 40 (S24). Examples of the historical data include operation data obtained time after time, accumulation history such as the total operating time, variations of temperatures, pressures, and so on at sites at the activation/stop time or at the time when power varies, and their variations per unit time. That is, the operation data obtaining unit 20 obtains the past history of the operation data in addition to the operation data obtained through the sensors 10. The historical data may further include transient data indicating the state of the plant at the evaluation time, cumulative data of these transient data, and data resulting from the addition/subtraction of data at a plurality of given times, such as temperature/pressure variations at the sites of the turbine equipment 2. The operation data obtaining unit 20 obtains the historical data from the operation data storage unit 40.

Further, the operation data obtaining unit 20 performs accumulation arithmetic processing of the transient data (operation data) obtained from the operation data storage unit 40 to generate historical data (S25). The generated historical data is stored in the operation data storage unit 40 (S26). Note that the historical data generated by the operation data obtaining unit 20 is not limited to one based on the operation data obtained through the sensors 10. If the plant is an existing plant that has been kept operating for a certain period, the operation data obtaining unit 20 may obtain/accumulate operation history from the operation start time up to the device installation time and store the result in the operation data storage unit 40. Further, the operation data may be input through the input unit 35 to be stored in the operation data storage unit 40.

(Operating State Quantity Evaluation Unit 50)

The operating state quantity evaluation unit 50 uses the operation data and the historical data obtained and generated by the operation data obtaining unit 20 to calculate a state quantity of a predetermined evaluation-target site of the rotor 4, the turbine casing 3, or the like inside the turbine equipment 2. Examples of the state quantity calculated by the operating state quantity evaluation unit 50 include temperature, stress, and strain at the predetermined evaluation-target site in the turbine equipment. Note that the cumulative time during which the plant is operated under these state quantities may be included in the state quantity.

Examples of a calculation method by the operating state quantity evaluation unit 50 includes (1) for the calculation of temperature at a given evaluation-target site, a method of estimating steam temperature based on the temperature measurement data at the steam inlet 11 and the steam outlet 12 of the turbine casing 3 illustrated in FIG. 2 and a condition such as turbine power and finding a heat balance of the turbine stages by balance calculation, (2) a method of creating, in advance, a relational formula of evaluation-target site temperature with measurement data of various sensors installed at predetermined positions in the turbine casing 3 and so on to find the temperature of the evaluation-target site based on the relational formula, and (3) a method of creating a relational formula of load stress at a predetermined site with turbine power, turbine inlet-side temperature, turbine outlet-side temperature, measurement data of the sensors 10*a* to 10*h* installed at the predetermined positions in the turbine casing 3 and so on, and calculating the load stress at the predetermined site based on the created relational formula. Here, the conditions such as the turbine power and the relational formula can be stored in advance in the operation data storage unit 40.

Depending on the configuration of the plant where the damage evaluation device 1 is installed, evaluation-target equipment, and the number of evaluation-target sites, it is sometimes difficult to perform calculation processing on all the successively transmitted operation data. An adoptable configuration example in such a case is to store state quantities of the evaluation-target sites in advance in the operation data storage unit 40 with respect to expected operation data and output the state quantities at a predetermined evaluation-target site using the operation data stored in the operation data storage unit 40 instead of the operation data obtained through the sensors 10.

(Material Deterioration Evaluation Unit 60)

Figure 4:
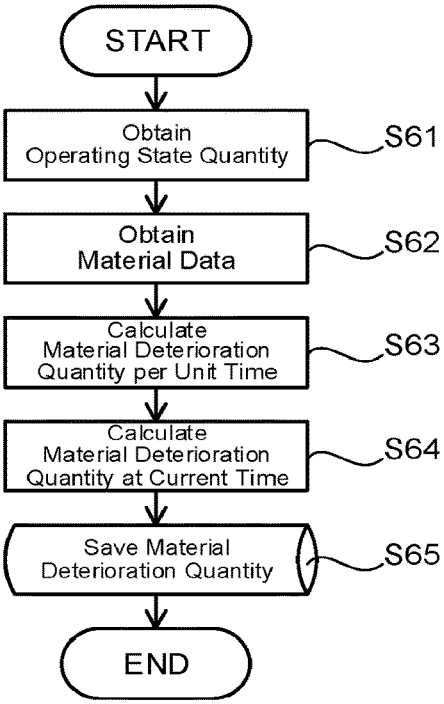
FIG. 4 is a flowchart illustrating an operation of a material deterioration evaluation unit according to the embodiment.

The material deterioration evaluation unit 60 estimates a material deterioration quantity at a given evaluation-target site of the turbine equipment 2 based on the state quantity at the predetermined evaluation-target site calculated by the operating state quantity evaluation unit 50 and material data of an evaluation-target component such as the rotor 4 or the turbine casing 3 which data is stored in advance in the evaluation-target component material storage unit 30. Examples of the material data include chemical components, crystal grain sizes, and strength data such as hardness, yield strength, and impact values of the materials forming the turbine equipment 2. Examples of the material deterioration quantity include a hardness decrease quantity and an embrittlement quantity. FIG. 4 illustrates an example of an evaluation operation by the material deterioration evaluation unit 60. In the evaluation of the material deterioration quantity per unit time at the current time, the unit time refers to any time zone within a period in which the input operating state quantity such as temperature and stress can be regarded as constant. The unit time may be set in advance or may be decided one after another by monitoring a change in the operating state quantity or a variation of some operation data that is an input in the calculation thereof. The material deterioration evaluation unit 60 obtains the state quantity calculated by the operating state quantity evaluation unit 50 (S61) and then obtains the material data of the evaluation-target component (S62).

The material deterioration evaluation unit 60 calculates the material deterioration quantity per unit time by the following formula based on the material data and the operating state quantity of the evaluation-target component (S63).

$$\text{material deterioration quantity}=f(\text{material data,operating state quantity,operating time}) \quad (1)$$

That is, the material deterioration quantity is found by an arithmetic formula whose parameters are the material data, the operating state quantity, and the operating time.

Next, the material deterioration evaluation unit 60 accumulates the calculated material deterioration quantity per unit time to calculate a material deterioration quantity at the current time (S64). The material deterioration evaluation unit 60 saves the calculated material deterioration quantity in the evaluation-target component material storage unit 30 (S65).

The following is an example of the calculation of the material deterioration quantity. The following formula is used for the estimation of hardness, $$\text{hardness} = f(\text{material data, operating state quantity, operating time}) = A + B \cdot g(S, T, t) \quad (2)$$

where A and B are constants determined by the material data, and g(S, T, t) is a function of stress, temperature, and operating time at the current time. The following is an example of the function g, $$g(S,T,t)=\ln\{\exp(E-H_0)/F+\beta\cdot(S/G)^{\gamma}\cdot\exp(-H/T)t\} \quad (3)$$

where E, F, G, and H are constants determined by the material data of the evaluation-target site, β· and γ are constants experimentally found in advance, $H_0$ is initial hardness, S is stress, T is temperature, and t is time.

The following is another example of the calculation of the material deterioration quantity. The following formula is an example used for the calculation of an embrittlement quantity, $$\text{embrittlement quantity} = f(\text{material data, operating state quantity, operating time}) = g(A, T)\cdot h(B, T, t) \quad (4)$$

where A and B are constants determined by the material data, g(A, T) is a function of the constant of the material data and operating temperature, and h(B, T, t) is a function of the constant of the material data, operating temperature, and time. The constants A and B are each calculated from a sum value of weighted weights by mass of given impurity elements in chemical components of the material at the time of its manufacture or from a product by the sum value.

$$A=(2\cdot\text{Si}+\text{Mn}+\text{Ni}+\text{Cu})\times\cdot B \quad (5)$$

$$B=10\cdot B+5\cdot Sb+4\cdot\text{Sn}+\text{As} \quad (6)$$

where Si, Mn, Ni, Cu, P, Sb, Sn, and As are the masses of the impurity elements.

Thus, the material deterioration quantity is expressed as the above estimation formulas. An estimation formula other than the above may be used for the evaluation. It is also possible to calculate the material deterioration quantity at the current time by calculating the material deterioration quantity per unit time based on these formulas and accumulating the calculated material deterioration quantity (Risk Evaluation Unit 70)

Figure 5:
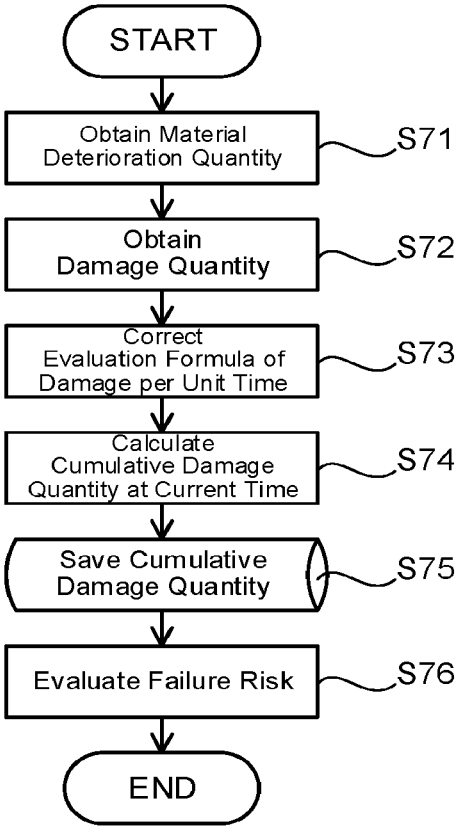
FIG. 5 is a flowchart illustrating an operation of a risk evaluation unit according to the embodiment.

The risk evaluation unit 70 evaluates creep damage and fatigue damage of a given evaluation-target site at the current time using the state quantity such as the temperature and the load stress of the evaluation-target site obtained by the operating state quantity evaluation unit 50 and the material deterioration quantity evaluated by the material deterioration evaluation unit 60, to calculate a damage quantity. It also has a function of predicting a future deformation quantity and evaluating failure risk, based on the obtained damage quantity and material deterioration quantity, and an operation plan that is separately input. FIG. 5 illustrates a damage quantity calculation operation by the risk evaluation unit 70. In the correction of an evaluation formula of damage per unit time at the current time, the unit time in the creep damage evaluation refers to any time zone within a period in which the material deterioration quantity and the state quantity such as temperature and stress can be regarded as constant. The unit time may be set in advance or may be decided one after another by monitoring a change in the operating state quantity or a variation of the operation data which is an input of the calculation thereof. On the other hand, the unit time in the fatigue damage refers to a time from an instant when generated stress or strain starts increasing or decreasing up to an instant when it starts decreasing or increasing again or up to an instant when there is no change in the state quantities such as temperature and stress and these state quantities can be regarded as constant.

The risk evaluation unit 70 obtains the material deterioration quantity evaluated by the material deterioration evaluation unit 60 from the evaluation-target component material storage unit 30 (S71) to calculate the damage quantity (S72). Next, the risk evaluation unit 70 corrects the evaluation formula of damage per unit time based on the calculated damage quantity (S73).

Specifically, based on hardness at the current time output from the material deterioration evaluation unit 60, the risk evaluation unit 70 corrects a creep-rupture curve used for the evaluation of creep damage per unit time and calculates a creep-rupture time under this state quantity using this formula. A ratio of the creep-rupture time and the unit time is a creep damage quantity in the unit time.

Figure 6:
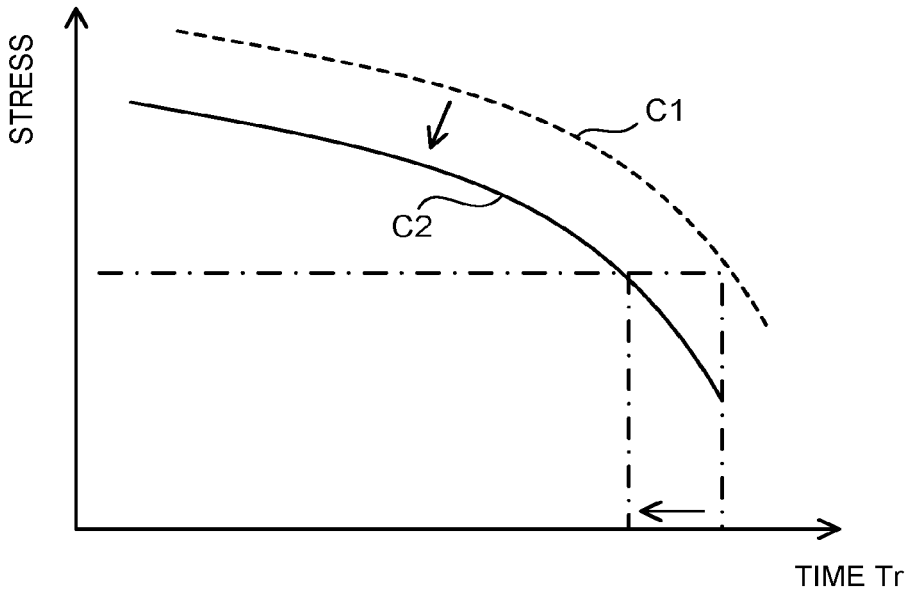
FIG. 6 is an explanatory chart of creep damage evaluation according to the embodiment.

FIG. 6 illustrates a schematic chart of a creep-rupture curve used for the evaluation of creep crack initiation life. The occurrence of time-dependent material deterioration accompanying plant operation shortens the time up to crack initiation (life). Therefore, the curve is corrected from, for example, the C1 curve to the C2 curve in FIG. 6 according to the material deterioration quantity, for example, hardness decrease. The following is an example of the correction formula of the creep-rupture curve based on hardness, $$A+B\times\log(S)+C\times\log(S)^2=(T+273)(D+\log(tr)) \quad (7)$$

where S is stress, tr is creep-rupture time, T is use temperature, A, B, and C are constants determined by hardness, and D is a constant.

The risk evaluation unit 70 adds the found creep damage quantity per unit time to the cumulative damage quantity stored in the operation data storage unit 40 to calculate the cumulative creep damage quantity at the current time (S74). The risk evaluation unit 70 saves, in the operation data storage unit 40, the cumulative damage quantity, the cumulative creep damage quantity at the current time, and so on (S75).

Figure 7:
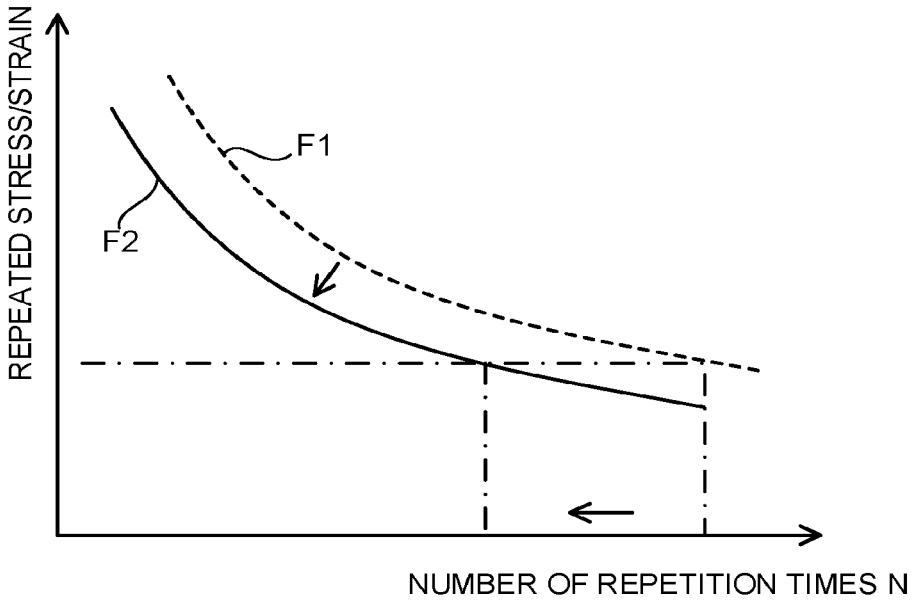
FIG. 7 is an explanatory chart of fatigue damage evaluation according to the embodiment.

The same calculation used in the creep damage evaluation is applicable to the fatigue crack initiation evaluation. FIG. 7 illustrates a schematic chart of a fatigue curve used for the fatigue crack initiation evaluation. As in the above-described creep damage evaluation, the risk evaluation unit 70 corrects the fatigue curve from the F1 curve to the F2 curve in FIG. 7 according to material hardness. The following is an example of a correction formula, $$\Delta S=A\times N^B+C\times N^D \quad (8)$$

where ΔS is stress or strain amplitude, N is crack initiation life (the number of repetition times up to crack initiation), A and B are variables determined by hardness, and C and D are constants determined by an evaluation-target site.

The number of repetition times corresponding to life is calculated based on a variation of stress or strain generated in the unit time, and a ratio of this number of repetition times and the number of repetition times of stress or strain generated in the unit time is a fatigue damage quantity in the unit time. Then, this fatigue damage quantity per unit time is added to the cumulative damage quantity stored in the operation data storage unit 40, whereby a cumulative fatigue damage quantity at the current time is calculated. The cumulative fatigue damage quantity at the current time is also saved in the operation data storage unit 40.

Figure 8:
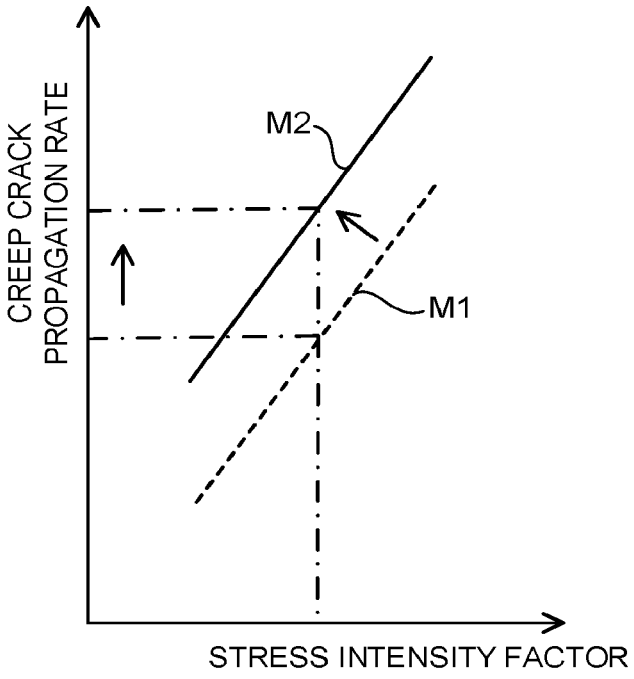
FIG. 8 is an explanatory chart of crack growth evaluation according to the embodiment.
Figures 9, 10:
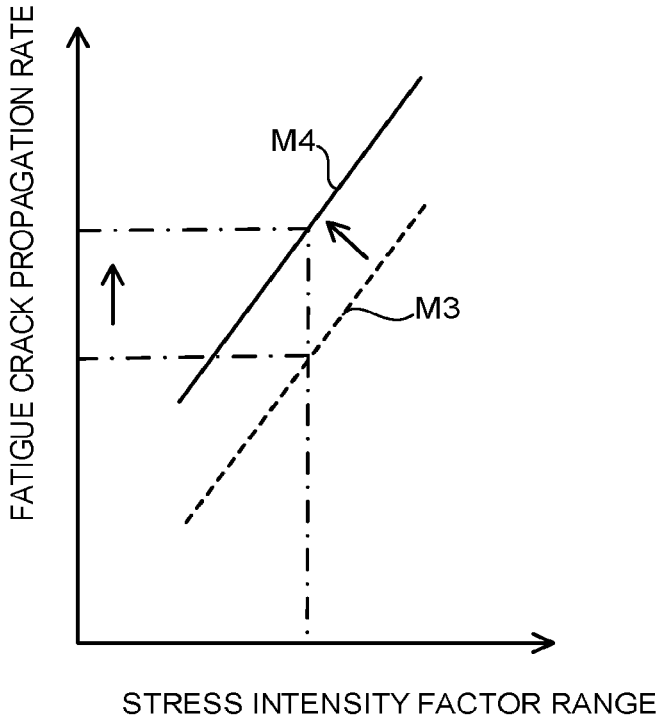
FIG. 9 is an explanatory chart of crack growth evaluation according to the embodiment.
FIG. 10 is an explanatory chart of failure risk evaluation according to the embodiment.

In the above example, the crack initiation is considered as failure and a damage ratio is calculated, and in the evaluation of damage due to crack growth as well, a crack propagation curve is similarly corrected according to the material deterioration quantity, and crack growth damage is evaluated. FIG. 8 and FIG. 9 illustrate schematic charts of crack propagation curves. The crack propagation rate increases with material deterioration, for example, embrittlement. The following formulas are examples of a correction formula of the crack propagation curve, correction formula of creep crack propagation rate:

$$da/dt=A\times K^B \quad (9)$$

correction formula of fatigue crack propagation rate:

$$da/dN=C\times\Delta K^D \quad (10)$$

where da/dt and da/dN are crack propagation rate, K is stress intensity factor, ΔK is stress intensity factor range, and A, B, C, and D are variables determined by use temperature and an embrittlement quantity. In the examples illustrated in FIG. 8 and FIG. 9, the characteristic lines representing the crack propagation rate are corrected from M1 to M2 and from M3 to M4.

A crack growth quantity per unit time is calculated from this crack propagation rate and accumulated, whereby a crack length is calculated. A damage quantity is calculated from a ratio of this crack length to the limit crack length determined by the material deterioration quantity such as an embrittlement quantity, the material data, and the operating state quantity or to the limit crack length decided in advance in design data.

The obtained damage quantity is not only output but also can be saved in the operation data storage unit 40. As the damage quantity, a creep damage quantity and a fatigue damage quantity may be separately evaluated or the combination of these may be evaluated.

The risk evaluation unit 70 evaluates failure risk using the calculated damage quantity at the current time and other state quantities (S76). FIG. 10 illustrates an example of the evaluation of the failure risk in this embodiment. In this embodiment, the level of the failure risk is set in advance based on the damage quantity and the total operating time. The thresholds (A, B, a, b) in FIG. 10 are constants decided in advance according to a design condition, a material used, and so on of each evaluation-target member. In this example, a rotor or a casing is taken as an example, and its damage quantity is calculated from an expected damage form, but a prediction error occurs in the damage quantity because of variation in material deterioration and material strength. Since this error increases in proportion to an increase in the operating time, the use of two parameters of the damage quantity and the total operating time for the evaluation of the failure risk enables appropriate risk evaluation.

For example, if the total operating time is "a" hours or more and the damage quantity is A % or more, the failure risk is determined as high. On the other hand, if the total operating time is "b" hours or less and the damage quantity is B % or less, the failure risk is determined as low.

In this evaluation, the method to evaluate the risk from a matrix of the two parameters is described, but the method is not limited to this. For example, operating rate, average operating temperature, the number of activation and stop times, and so on may be used as parameters, and as the damage quantity, a creep damage quantity and a fatigue damage quantity may be used separately for the evaluation. It is also possible to calculate a failure probability using a probability theory method instead of uniquely deciding the risk using the matrix of the parameters. In this example, the failure risk is calculated using the damage quantity that is estimated in real time based on the operation data, but if a parameter that makes the calculated damage quantity indefinite is used together for the evaluation of the failure risk, the risk can be appropriately evaluated.

(Recommended Maintenance Time Presentation Unit 80)

Using data such as the cumulative damage and the result of the damage quantity and failure risk evaluation generated by the risk evaluation unit 70, the recommended maintenance time presentation unit 80 predicts a future damage quantity based on operation plan data that a user separately inputs through the input unit 35, and proposes a recommended maintenance time. The recommended maintenance time presentation unit 80 has a device for displaying such as a display device and is capable of presenting the contents of the proposal to the user. Here, the operation plan is information indicating, for example, an operating rate, average power, and the frequency of activations and stops of the facility, and is stored in advance in the operation data storage unit 40. Based on a data set of the operation data and historical data which are linked to the obtained damage quantity and material deterioration data, the recommended maintenance time presentation unit 80 calculates a material deterioration quantity and a cumulative damage quantity that are expected in the given operation plan.

An example using the cumulative operating time will be described as a calculation example. Any time unit is set in advance from the relation between the historical data and the material deterioration quantity, and the relation of the material deterioration quantity and the operating time in this time unit is obtained, whereby it is possible to predict the trend of the material deterioration quantity from the operating time that the user separately inputs. Similarly, from the historical data, a change in the state quantity such as temperature and load stress in the unit time is predicted. From these material deterioration quantity and state quantity, a creep damage quantity is predicted. Similarly, as for fatigue damage, the magnitude of generated load stress and the number of times it is generated per unit operating time are estimated and this estimation is combined with the material deterioration prediction, whereby it is possible to predict the fatigue damage quantity. In this example, the cumulative operating time is used as a parameter, but plant power, an operating rate, or an evaluation formula is also usable, for instance.

A future failure risk is evaluated again using the damage quantity thus predicted, and from the result, the recommended maintenance time is presented. The method illustrated in FIG. 10 is used for the failure risk evaluation, and the recommended maintenance time is proposed based on the evaluation result.

As described above, the damage evaluation device of the embodiment successively calculates the operating state quantity at a given evaluation-target site of the rotor, the casing, or the like from the data obtained during the operation of the turbine equipment, estimates the material deterioration quantity at the current time from the operating state quantity and the historical data, and based on these, evaluates the cumulative damage due to the crack initiation or growth, evaluates the failure risk, and goes so far as to recommend the maintenance time based on the future operation plan. That is, successively calculating the material deterioration quantity based on the obtained data can reduce the opportunities when the deterioration quantity is measured while the turbine is opened. Further, the creep damage quantity and the fatigue damage quantity are calculated in the unit time in which the successively calculated state quantity such as temperature and stress can be regarded as constant, and are accumulated, which makes it possible to appropriately evaluate the damage quantity even in a part-load operation involving the change in the state quantity.

Owing to these characteristics, even in the case where, for example, a load-varying operation and the number of activation and stop times increase, it can be expected that highly reliable maintenance and management are achieved because damage is successively predicted based on the latest operating state. Further, it is possible to predict the material deterioration quantity and the damage quantity without executing a large-scale inspection by opening the turbine, and cost reduction can be expected. It should be noted that, though the application example to the thermal power plant including the steam turbine and the boiler is described in this example, this configuration is not restrictive.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A damage evaluation device that evaluates damage of equipment, the damage evaluation device comprising:

an operation data obtaining unit, implemented by processing circuitry, which obtains operation data indicating a state of the equipment detected by a sensor disposed at a predetermined position of the equipment, the state of the equipment including a generated stress by load of the predetermined position of the equipment;

an operating state quantity evaluation unit, implemented by the processing circuitry, which calculates an operating state quantity including at least one of temperature and the generated stress at a predetermined evaluation-target site of the equipment, based on a relational formula of the stress of the predetermined evaluation-target site of the equipment with the operating state quantity, previously created based on the operation data;

a material deterioration evaluation unit, implemented by the processing circuitry, which calculates a material deterioration quantity of a material forming the equipment, based on the operating state quantity and material data of the predetermined evaluation-target site of the equipment;

a risk evaluation unit, implemented by the processing circuitry, which calculates a cumulative damage quantity based on an accumulation of a creep damage quantity or a fatigue damage quantity in a unit time based on:

a damage evaluation formula giving at least one of the creep damage quantity and the fatigue damage quantity of the evaluation-target site, given based on the operating state quantity and the material deterioration quantity; and the operating state quantity and variation information on varying stress or varying strain in the unit time in which the operating state quantity is considered constant, the risk evaluation unit further determining at least one of the cumulative damage quantity of the material forming the equipment and failure risk, based on the cumulative damage quantity; and a display which presents a recommended maintenance time of the equipment based on a result of a determination of the risk evaluation unit.

2. The damage evaluation device according to claim 1, further comprising:

a sensor which detects the state of the equipment; and a memory which stores the operation data, wherein the operation data obtaining unit performs accumulation of the operation data based on operation data obtained through the sensor and historical data containing the operation data in the past obtained from the memory, and stores resultant data in the memory.

3. The damage evaluation device according to claim 1, further comprising a material memory which stores material data including a property of the material forming the equipment, wherein the material deterioration evaluation unit calculates the cumulative damage quantity based on the operation data and the material data.

4. A damage evaluation method of evaluating damage of equipment, the method comprising:

detecting a state of the equipment detected by a sensor disposed at a predetermined position of the equipment, the state of the equipment including a generated stress by load of the predetermined position of the equipment, to obtain operation data;

calculating an operating state quantity including at least one of temperature and generated stress at a predetermined evaluation-target site of the equipment, based on a relational formula of the stress of the predetermined evaluation-target site of the equipment with the operating state quantity, previously created based on the operation data;

calculating a material deterioration quantity of a material forming the equipment, based on the operating state quantity and material data of the predetermined evaluation-target site of the equipment;

calculating a cumulative damage quantity based on an accumulation of a creep damage quantity or a fatigue damage quantity in a unit time based on:

a damage evaluation formula giving at least one of the creep damage quantity and the fatigue damage quantity of the evaluation-target site, given based on the operating state quantity and the material deterioration quantity, and the operating state quantity and variation information on varying stress or varying strain in the unit time in which the operating state quantity is considered constant, the calculating of the cumulative damage quantity includes determining at least one of the cumulative damage quantity of the material forming the equipment and failure risk, based on the cumulative damage quantity; and presenting a recommended maintenance time of the equipment based on a result of the determining.

* * * * *